US008443854B2

(12) United States Patent
Long

(10) Patent No.: US 8,443,854 B2
(45) Date of Patent: May 21, 2013

(54) SLIDING DRAWER CARD HOLDER AND EXTRACTOR

(75) Inventor: Michael Long, Frederick, MD (US)

(73) Assignee: Novate Media LLC

( * ) Notice: Subject to any disclaimer, the term of this patent is extended or adjusted under 35 U.S.C. 154(b) by 176 days.

(21) Appl. No.: 11/975,022

(22) Filed: Oct. 18, 2007

(65) Prior Publication Data

US 2009/0101255 A1 Apr. 23, 2009

(51) Int. Cl.
*G09F 11/30* (2006.01)

(52) U.S. Cl.
USPC ..... 150/147; 150/131; 40/513; 40/490; 221/232; 221/155; 206/38; 206/39.5; 206/39.4

(58) Field of Classification Search
USPC ..... 150/147, 131; 221/232, 155; 206/38, 206/39.5, 39.4
See application file for complete search history.

(56) References Cited

U.S. PATENT DOCUMENTS 1,470,709 A * 10/1923 Cook ..... 221/260
4,242,820 A * 1/1981 Ackeret ..... 40/513
4,717,908 A * 1/1988 Phillips et al. ..... 340/568.7
4,792,058 A * 12/1988 Parker ..... 221/232
4,887,739 A * 12/1989 Parker ..... 221/232
5,730,319 A * 3/1998 Gray et al. ..... 221/259
7,287,666 B2 * 10/2007 De Laforcade ..... 221/65
7,320,413 B2 * 1/2008 Fusi ..... 221/255
7,331,366 B1 * 2/2008 Patterson ..... 150/149
7,334,616 B2 * 2/2008 Kaminski ..... 150/147
7,520,425 B2 * 4/2009 Clegg ..... 235/380
7,571,752 B1 * 8/2009 Donohoe ..... 150/134
2005/0274733 A1 * 12/2005 Fusi ..... 221/232
2006/0076094 A1 * 4/2006 Kaminski ..... 150/147

* cited by examiner

*Primary Examiner* — Anthony Stashick
*Assistant Examiner* — Cynthia Collado
(74) *Attorney, Agent, or Firm* — H. Jay Spiegel

(57) ABSTRACT

Two components slide with respect to one another, and hold a stack of cards. A first component includes three members extending into a chamber formed by its C-shaped cross-section. When the components are slid apart, the first card in the stack is partially exposed. The card is pushed back past the outer members providing resistance to prevent the cards from moving while allowing only the top card to be pushed past the outer appendages to expose the next card. When the components are pushed together, a bump on an L-shaped component assures that the cards are aligned in a stack. The two outer members include tangs at their terminations that retain a stack of cards within the chamber and prevent them from sliding past. Between the outer members, a central spring extends in an angled configuration into the chamber and presses against the cards and frictionally retains them in position within the chamber.

13 Claims, 7 Drawing Sheets

SLIDING DRAWER CARD HOLDER AND EXTRACTOR

BACKGROUND OF THE INVENTION

The present invention relates to a sliding drawer card holder and extractor. In the prior art, purses, wallets and purse organizers as well as other types of cases or containers are well known for use in storing a variety of items within a purse or a person's pocket. Among such items are a variety of structures incorporated into wallets or separate structures and intended for use in storing credit cards.

A typical wallet holds a variety of items including currency as well as credit cards, driver's licenses, ATM cards, and membership cards in a variety of entities that must be easily stored and accessed when needed. Credit and debit cards typically have the same structure including dimensions and thickness that facilitate their being stacked one above the other to create a stack of cards of the same dimensions. It would be advantageous to provide a device facilitating storing of credit cards and debit cards in a stack of such cards that may easily be retained and just as easily retrieved one at a time when needed.

Applicant is aware of U.S. Pat. No. 6,412,627 to Tiscione et al. Tiscione et al. teach a card holder and ejector in which an ejector mechanism facilitates dispensing of one card at a time. The cards are stored in a stack and complicated spring biased mechanisms are employed to eject cards as desired. The mechanism of Tiscione et al. is extremely cumbersome and unwieldy and its mechanical parts make it susceptible to breakage and unreliability.

It would be advantageous if an invention were devised to store and easily dispense credit cards using a simple and uncomplicated dispensing mechanism. It is with this thought in mind that the present invention was developed.

SUMMARY OF THE INVENTION

The present invention relates to a sliding drawer card holder and extractor. The main goal of the present invention is to improve on a mechanism to store and retrieve wallet-sized cards, making such a device as compact and uncomplicated as possible.

The present invention includes the following interrelated objects, aspects and features:

(1) In a first aspect of the present invention, in its preferred embodiment, it is made up of two simple molded components that are attached together in a manner that they may slide with respect to one another. A first component has a generally C-shaped cross-section and includes integrally molded therein three elongated members that extend into a chamber formed by the C-shaped cross-section. When the components are slid with respect to one another, the first card in the stack is partially exposed. Using a thumb or forefinger, the card can be pushed back past the outer appendages which provide resistance enough to prevent the stack of cards from moving while allowing only the current top card in the stack to be pushed past the outer appendages thus exposing the next card in the stack. The process can be repeated until the desired card is found. This card can then be removed from the stack using the thumb and forefinger. Cards can be added back into the stack of credit cards by pushing the cards directly into the stack. When the L-shaped component and the C-shaped component are pushed back together, an extruded bump on the L-shaped component assures that the cards are properly aligned in a stack and pushed forward over the outer appendages and back into the original state.

(2) The two outer appendages include upwardly extending tangs at their terminations that, in use, retain a stack of credit cards within the chamber and prevent them from sliding therepast. Between the two outer appendages, a central appendage extends vertically in an angled configuration into the chamber to act as a spring biasing means that presses against the stack of cards and frictionally retains them in position within the chamber.

(3) The other component of the present invention consists of a one piece molded device having a generally L-shaped cross-sectional configuration. The shorter leg of the L-shaped cross-sectional configuration closes an end of the chamber formed by the two components to absolutely preclude escape of a stack of credit cards from that end.

(4) One of the components includes opposed facing slots at the ends of its upper and lower short sides and these slots are sized to receive lateral edges of the L-shaped component so that the two components are guidingly assembled together for relative sliding movement with respect to one another. With the components so assembled, a generally rectangular cubic chamber is provided sized to receive a stack of credit cards and debit cards and to retain them in position therewithin until they are ready to be used.

(5) If desired, the C-shaped component may also include integrally formed therewith a clip-like member that enables the inventive device to be clipped within a shirt pocket, a pants pocket, a belt, waistband, or other location.

(6) When the user desires to obtain one of the credit or debit cards in the stack, the two components are slid with respect to one another so that the ends of the two outer legs hold the credit cards in position while they are revealed by this relative sliding movement while the spring integrally formed in the C-shaped component holds the stack together. Once the credit cards are revealed, they may be removed individually or as a stack, the desired credit card may be selected, and the device may be closed by relative sliding movement of the two components that may then be restored to a purse or pocket. The spring maintains constant pressure on the stack of cards at each orientation of the relatively movable components.

Accordingly, it is a first object of the present invention to provide a sliding drawer card holder and extractor.

It is a still further object of the present invention to provide such a device in which a stack of credit cards and/or debit cards may be easily and effectively stored when not in use.

It is a still further object of the present invention to provide such a device in which one or more credit cards or debit cards within a stack thereof may easily be accessed through relative sliding movement of two molded components.

It is a yet further object of the present invention to provide such a device in which elongated legs have upwardly extending tangs to assist in retaining a stack of credit and debit cards in place.

It is a still further object of the present invention to provide such a device in which an integrally molded spring leg presses against the stack of credit and debit cards to hold them in place within a chamber of the inventive device.

It is a still further object of the present invention to provide a clip allowing easy attachment of the inventive device on a pocket of a shirt, a pair of pants, a belt or a waistband.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
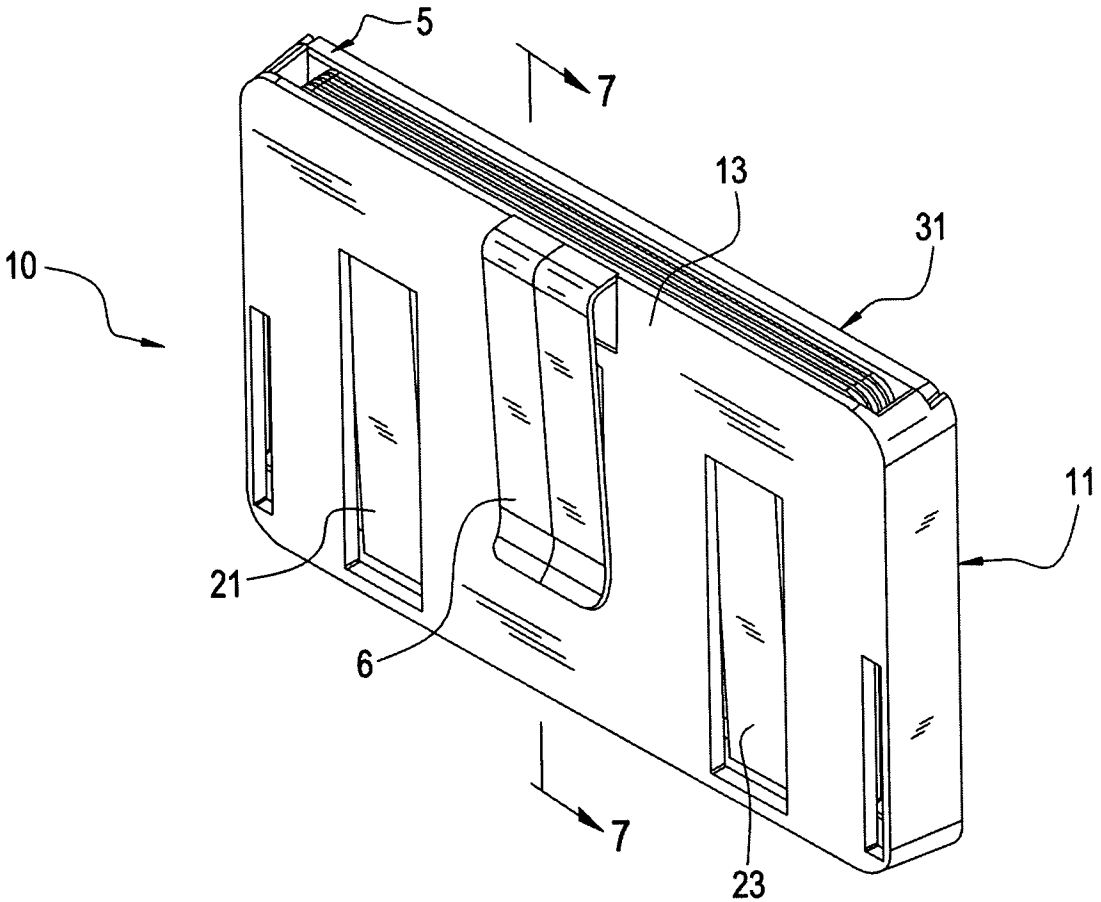
FIG. 1 shows a rear perspective view of the present invention in closed configuration.

Reference is first made to FIGS. 1-6 in which the present invention is generally designated by the reference numeral 10. As seen, the present invention consists of a first C-shaped component 11 and a second L-shaped component 31.

Figure 2:
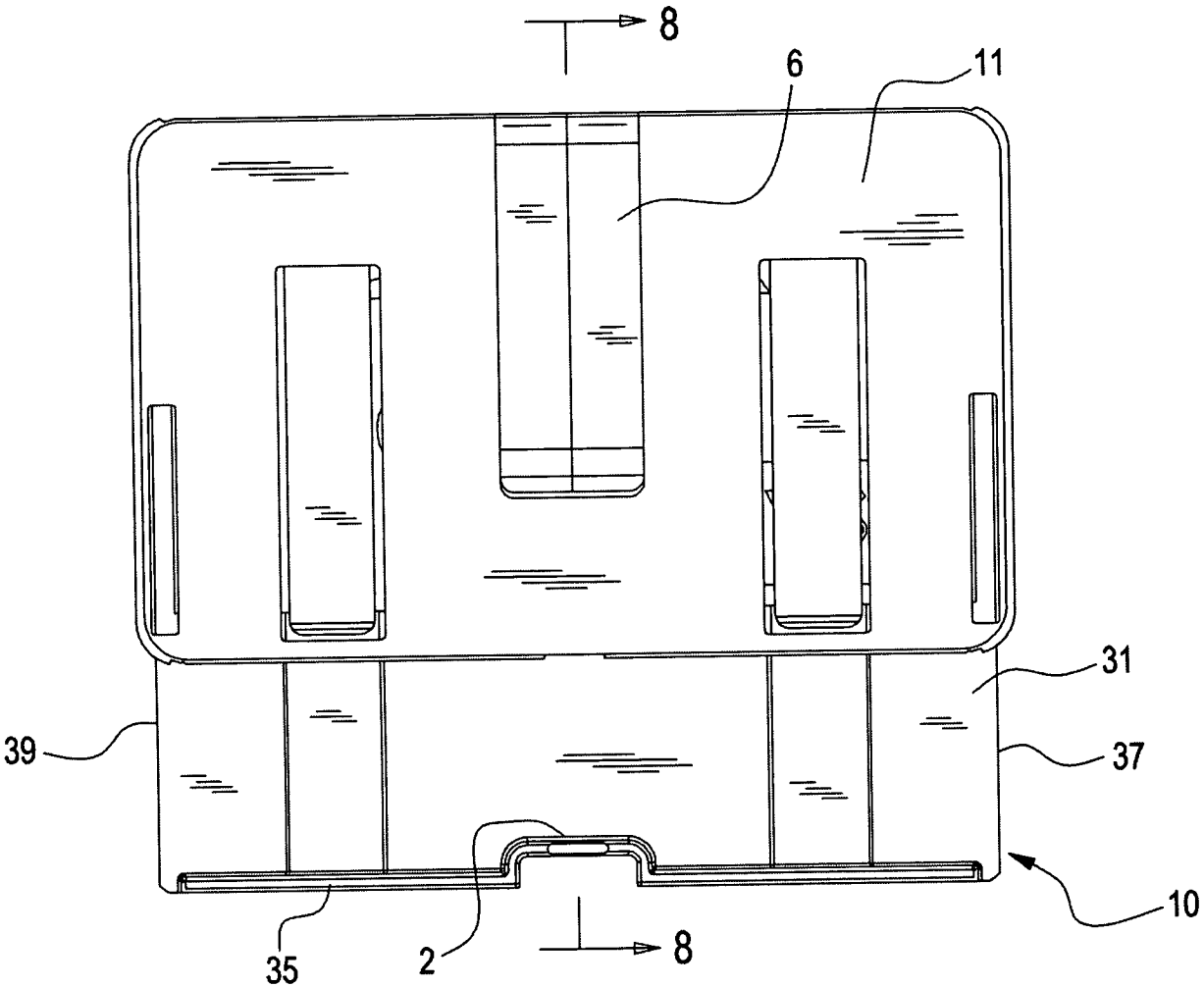
FIG. 2 shows a rear view of the present invention with the chamber partially open.
Figure 6:
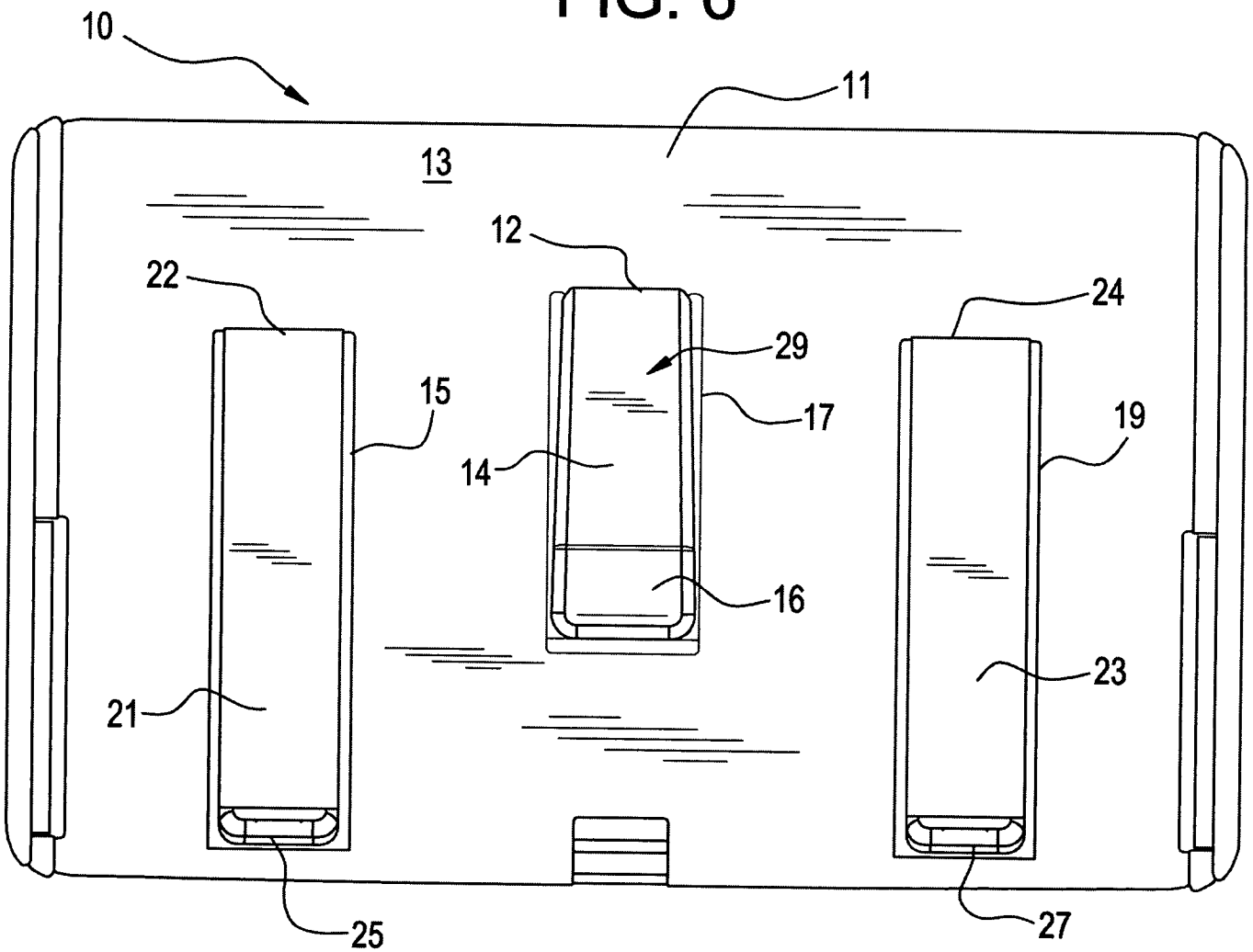
FIG. 6 shows a view from the same direction as that of FIG. 2, but with only the C-shaped component shown, and the pocket clip removed to show detail.

As seen in particular in FIGS. 1, 2 and 6, the C-shaped component includes a flat surface 13 including slots 15, 17 (FIG. 6) and 19 formed therein. Two elongated legs 21 and 23 fill the slots 15 and 19, respectively, and each of the legs 21 and 23 is attached to the component 11. The leg 21 is attached at 22 and the leg 23 is attached at 24. The leg 21 includes a short bent portion 25, while the leg 23 includes a short bent portion 27. The bent portions 25 and 27 extend into the paper in the view of FIG. 6, and the bent portion 25, for example, is clearly seen in FIG. 10.

With particular reference to FIG. 6, within the slot 17, a spring 29 is provided that pivots about the connection 12 with the flat surface 13 of the component 11. FIGS. 7-10 show the spring 29 which includes a generally elongated portion 14 and a bent end 16. The portions 14 and 16 meet at an intersection 18 that engages the stack of cards 1 (FIG. 7) to frictionally hold them in place.

Figure 3:
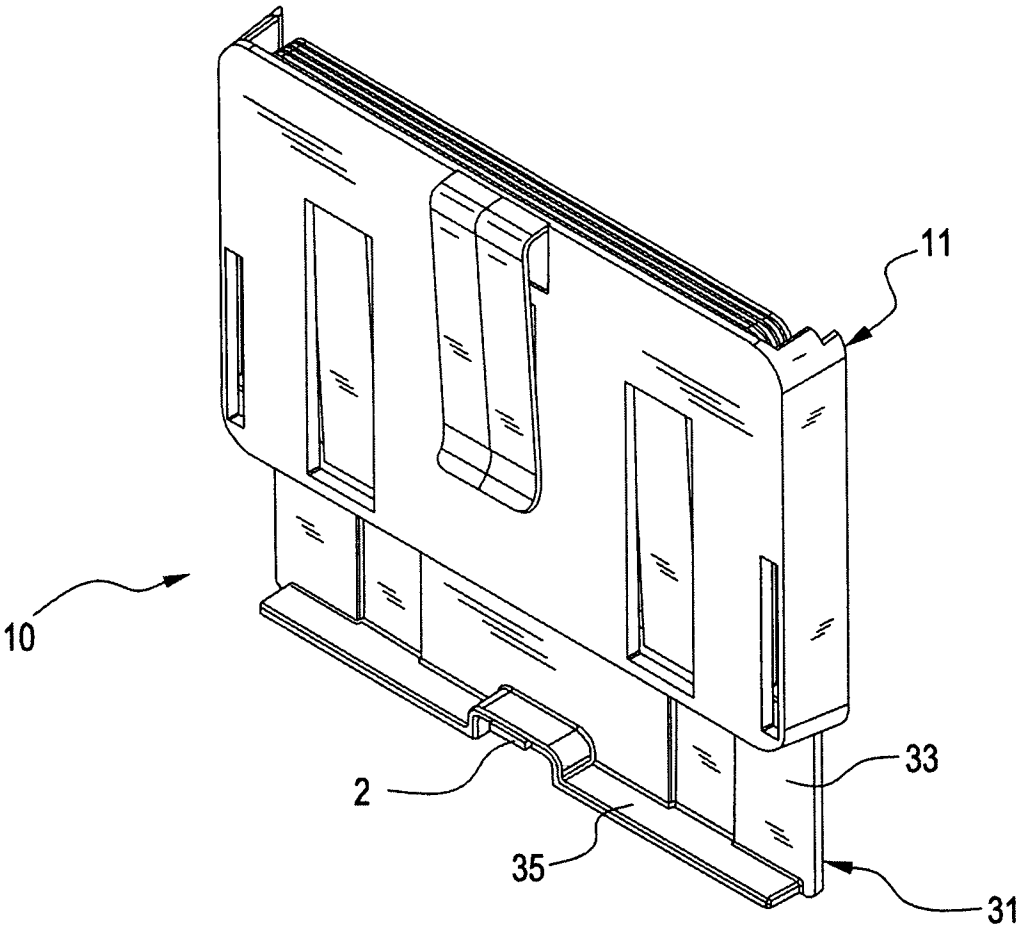
FIG. 3 shows a perspective view showing the same configuration shown in FIG. 2.
Figure 4:
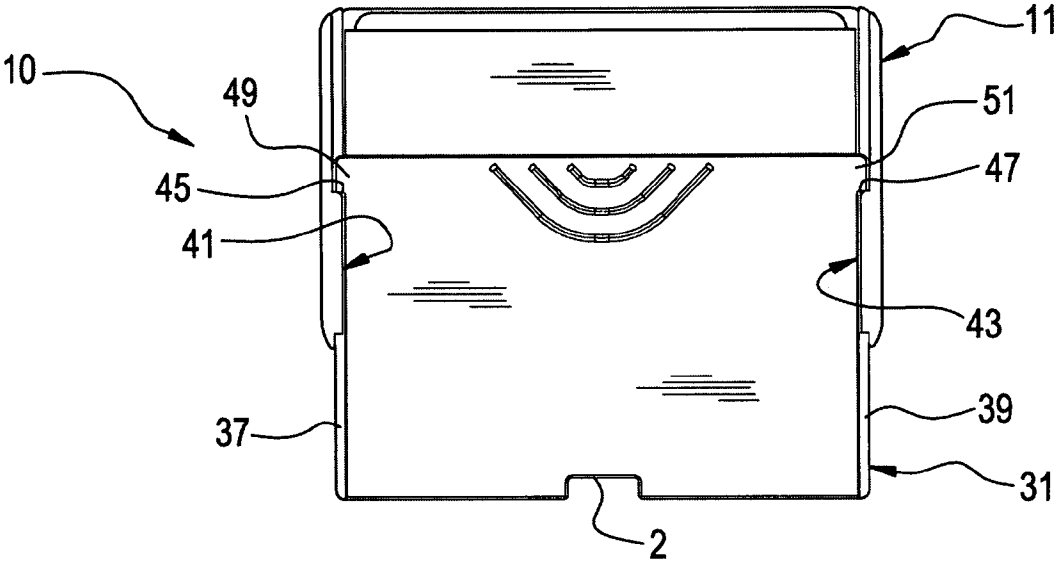
FIG. 4 shows a front view of the present invention in the same configuration as shown in FIGS. 2 and 3.
Figure 5:
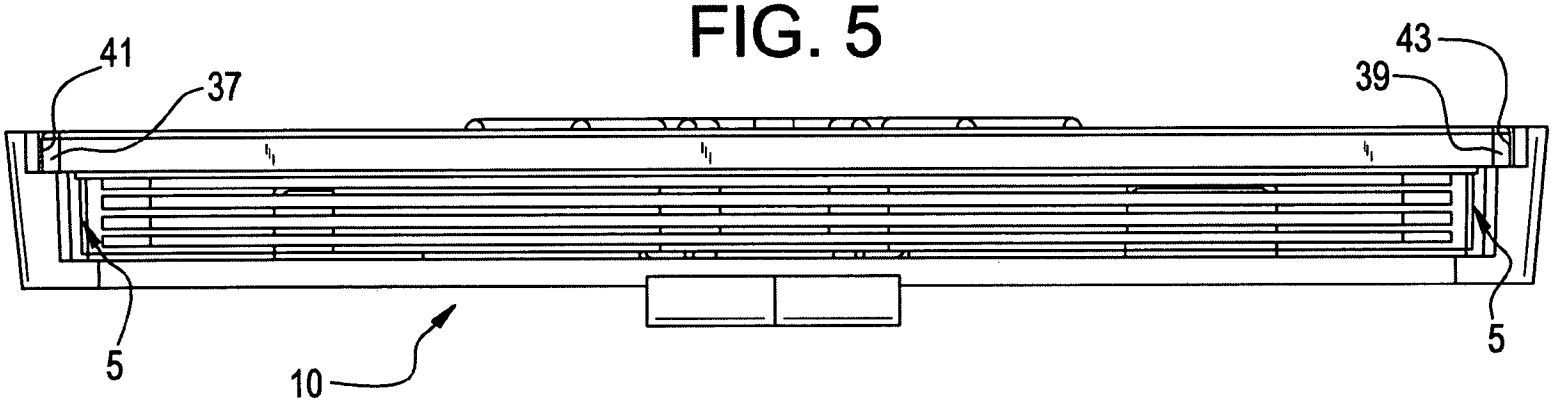
FIG. 5 shows an end view of the present invention.

With particular reference to FIGS. 2-4, the L-shaped component 31 will now be described. The L-shaped component 31 includes a generally flat rectangular body 33 that terminates at one end at a short leg 35. An extruded bump 2 extends toward the chamber 5. In one embodiment, the edges 37 and 39 of the L-shaped component 31 (FIG. 2) are thinner than the majority of the body 33, and are received in elongated grooves 41 and 43, respectively, in the C-shaped component 11 (FIGS. 4 and 5). As best seen in FIG. 4, the grooves 41 and 43 terminate at shoulders 45 and 47, respectively. With further reference to FIG. 4, the edges 37 and 39 terminate at laterally extending tabs 49 and 51, respectively. As clearly seen in FIG. 4, the tabs 49 and 51 limit the downward sliding of the component 31 in the view of FIG. 4 with respect to the component 11. With reference to FIG. 1, a clip 6 is formed on the component 11 and is sized and configured to allow the inventive device 10 to be releasably attached to a shirt pocket or pants pocket as well as to a belt or waistband of a pair of pants.

Figure 8:
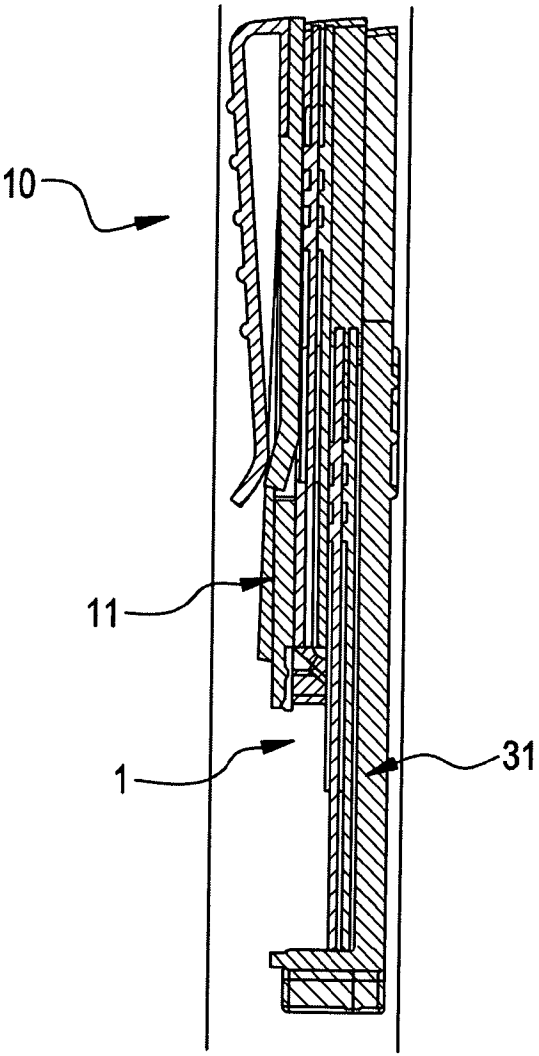
FIG. 8 shows a cross-sectional view along the line 8-8 of FIG. 2.
Figure 7:
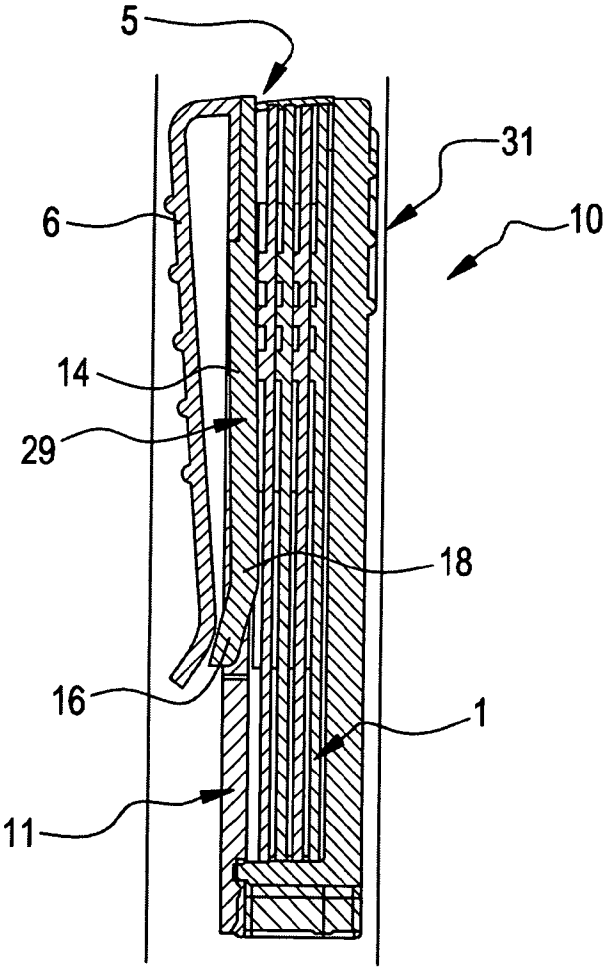
FIG. 7 shows a cross-sectional view along the line 7-7 of FIG. 1.
Figure 10:
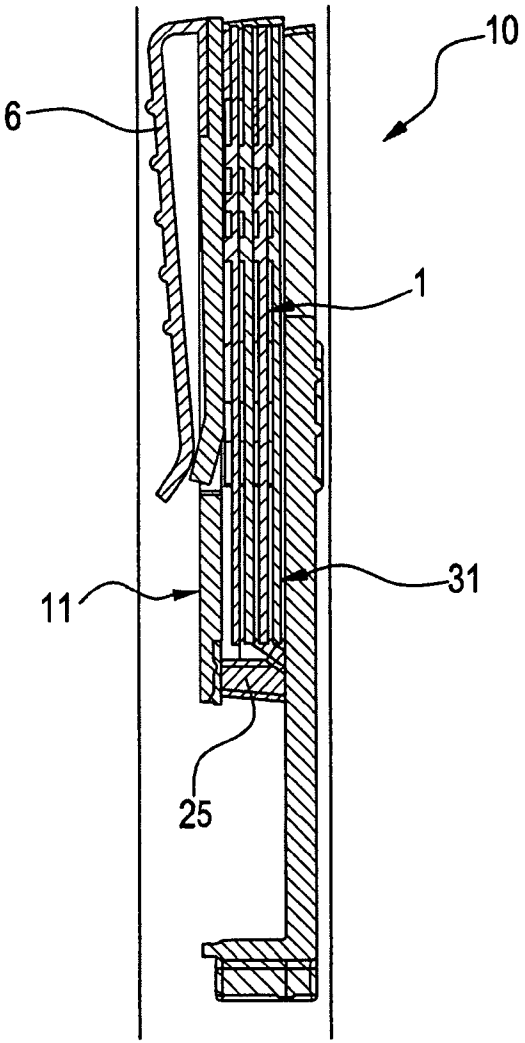
FIG. 10 shows a cross-sectional view similar to that of FIG. 9, but with the stack of cards moved deeper into the chamber.
Figure 9:
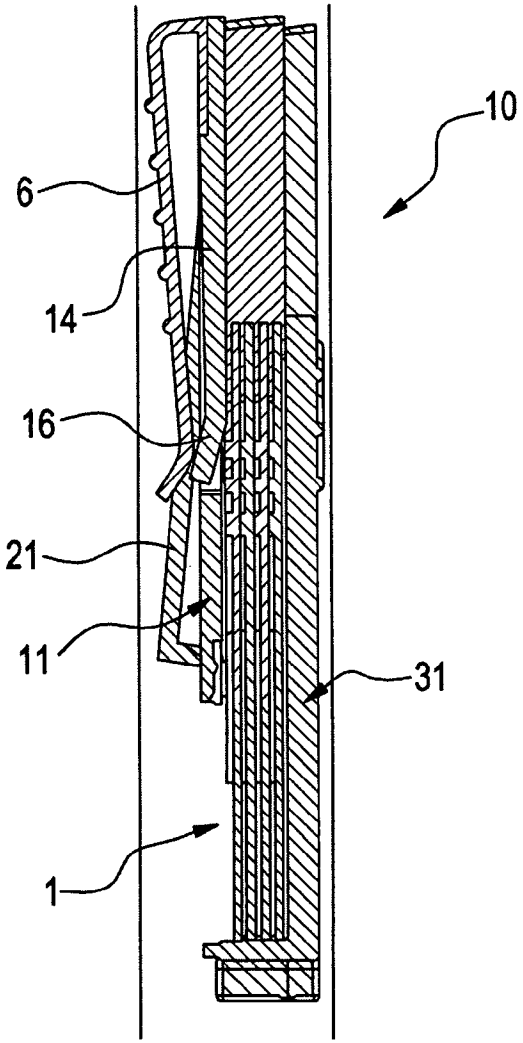
FIG. 9 shows a cross-sectional view similar to that of FIG. 8, but with all of the credit cards stacked together and the resultant movement of the biasing spring.

With reference to FIGS. 7-10, operation of the device 10 will be better understood. FIG. 7 shows the device 10 with the components 11 and 31 in a position creating the chamber 5 enclosing a stack of credit cards designated by the reference numeral 1. FIG. 8 shows the components 11 and 31 reciprocated with respect to one another to expose some of the credit cards in the stack 1. FIG. 9 is a view similar to that of FIG. 8, but with all of the cards in the stack 1 exposed. FIG. 10 shows the stack 1 enclosed within the chamber 5 of the inventive device. By comparing FIGS. 9 and 10, one can see the leg 21 in FIG. 9 bent away from the component 11 as compared to its position in FIG. 10 where it is not bent outwardly.

As should be understood, the spring 14 with its bent end 16 (FIG. 7) presses against the stack of cards 1, particularly as shown in the view of FIG. 7, to preclude the cards from sliding out of the chamber 5 of their own volition. As the components 11 and 31 are slid with respect to one another to expose the stack of cards 1, as shown in FIG. 10, the first card in the stack is partially exposed allowing it to be pushed back by the thumb or forefinger to expose the next card in the stack. The process can be repeated to access any card in the stack. Once the desired card is found, it can then be removed from the stack by grasping the card with the thumb and forefinger to remove it from the stack. FIG. 8 shows 2 cards that have been pushed back by the thumb past the resistant springs 21 and 22 which are used to prevent the entire stack from being pushed back and allowing only the top exposed card to be pushed.

When the components 11 and 31 are slid back together to the orientation shown in FIG. 1, the bump 2 in the L-shaped component 31 engages the edges of the cards 1 and causes them to become aligned with one another.

In the preferred embodiment of the present invention, the components 11 and 31 are made of a suitable molded thermoplastic such as, for example, nylon, ABS plastic, or polytetrafluoroethylene which is sold under the registered trademark "TEFLON." If desired, they may be made alternatively of a suitable metal such as aluminum or steel or, as a further alternative, they may be made partially of a plastic such as those listed above and partially of metal. For example, the component 11 may be made of plastic except for the spring 14 which may be made of metal and may be attached to the component 11 in any suitable manner such as via a slot with adhesive, screws, rivets, etc. Composite materials may also be employed.

As one example, the materials described above may suitably be employed in facing and engaging surfaces of the two components 11 and 31 to enhance their ability to slide with respect to one another when the chamber 5 is being exposed or closed. Thus, for example, "TEFLON" material could be used on the engaging surfaces.

The only requirement is that the components are rigid so that they perform their desired functions.

As such, an invention has been disclosed in terms of a preferred embodiment thereof which fulfills each and every one of the objects of the invention as set forth hereinabove, and provides a new and useful sliding drawer card holder and extractor of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A holder for a stack of cards, comprising:

a) a first component having a C-shaped cross-section and a second component having an L-shaped cross-section and coupled to said first component, said components movable with respect to one another from a first orientation to a second orientation;

b) a chamber defined between said components in said first orientation and sized to receive said stack of cards;

c) said first component having an integral spring having a first end attached to said first component and a second free end engaging said stack of cards to retain them within said chamber; and d) in said second orientation, said cards being accessible for removal from said chamber;

e) said first component including a pair of legs located on either side of said spring, said legs having bent ends lying in a common plane and configured to engage one edge of each of said cards to limit their movement within said chamber in a direction of insertion of said cards; and f) further wherein said C-shaped component comprises a generally rectangular first wall with two opposed short side walls extending generally perpendicular therefrom, said short walls terminating distal from said first wall with facing grooves.

2. The holder of claim 1, wherein said spring has a bent end.

3. The holder of claim 1, wherein said stack of cards comprises a plurality of debit cards and/or credit cards.

4. The holder of claim 1, wherein said L-shaped component includes a second wall with lateral edges received in said grooves and a short end wall extending generally perpendicularly therefrom.

5. The holder of claim 4, wherein said end wall includes a bump extending into said chamber in said first orientation, said bump aligning said cards.

6. The holder of claim 4, wherein said grooves terminate in shoulders limiting an extent of relative movement of said components to said second orientation.

7. The holder of claim 1, wherein said components are made of molded plastic.

8. The holder of claim 1, wherein one of said components includes a clip adapted to facilitate attachment of said holder to a pocket or belt or waistband.

9. The holder of claim 8, wherein said one of said components comprises said first component.

10. A holder for a stack of cards, comprising:

a) a first plastic component having a C-shaped cross-section and a second plastic component having an L-shaped cross-section coupled to said first component, said components movable with respect to one another from a first closed orientation to a second opened orientation;

b) a chamber defined between said components in said first orientation and sized to receive said stack of cards;

c) said first component having an integral spring, said spring having a first end attached to said first component and a second end that is bent and engages said stack of cards to retain them within said chamber;

d) in said second orientation, said cards being accessible for removal from said chamber;

e) said first component including a clip adapted to facilitate attachment of said holder to a pocket, belt or waistband;

f) said first component including a pair of legs located on either side of said spring, said legs having bent ends lying in a common plane and configured to engage one edge of each of said cards to limit their movement within said chamber in a direction of insertion of said cards; and g) further wherein said C-shaped component comprises a generally rectangular first wall with two opposed short side walls extending generally perpendicularly therefrom, said short walls terminating distally from said first wall with facing grooves.

11. The holder of claim 10, wherein said stack of cards comprises a plurality of debit cards and/or credit cards.

12. The holder of claim 10, wherein said L-shaped component includes a second wall with lateral edges received in said grooves and a short end wall extending generally perpendicularly therefrom, and wherein said end wall includes a bump extending into said chamber in said first orientation, said bump aligning said cards.

13. The holder of claim 12, wherein said grooves terminate in shoulders limiting an extent of relative movement of said components to said second orientation.

* * * * *